US007360526B2

(12) United States Patent
Kemmer

(10) Patent No.: US 7,360,526 B2
(45) Date of Patent: Apr. 22, 2008

(54) METHOD FOR OPERATING AN INTERNAL COMBUSTION ENGINE

(75) Inventor: Helerson Kemmer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/589,318

(22) PCT Filed: Nov. 17, 2005

(86) PCT No.: PCT/EP2005/056036

§ 371 (c)(1),
(2), (4) Date: Aug. 14, 2006

(87) PCT Pub. No.: WO2006/069850

PCT Pub. Date: Jul. 6, 2006

(65) Prior Publication Data

US 2007/0175453 A1 Aug. 2, 2007

(30) Foreign Application Priority Data

Dec. 23, 2004 (DE) ..... 10 2004 062 020

(51) Int. Cl.
*F02D 41/20* (2006.01)
*F02D 41/38* (2006.01)

(52) U.S. Cl. ..... 123/490; 361/154

(58) Field of Classification Search ..... 123/490; 361/152, 154, 155

See application file for complete search history.

(56) References Cited

U.S. PATENT DOCUMENTS

| | | | | |
|---|---|---|---|---|
| 4,639,822 | A * | 1/1987 | Kubach et al. | 123/490 |
| 5,182,517 | A | 1/1993 | Thelen et al. | 324/418 |
| 6,234,150 | B1 | 5/2001 | Watanabe | 123/490 |
| 6,390,082 | B1 | 5/2002 | Duffy et al. | 123/682 |
| 6,892,708 | B2 * | 5/2005 | Nasu | 123/490 |

FOREIGN PATENT DOCUMENTS

| | | |
|---|---|---|
| DE | 39 42 836 | 6/1991 |
| EP | 1 396 630 | 3/2004 |

* cited by examiner

*Primary Examiner*—T. M Argenbright
(74) *Attorney, Agent, or Firm*—Michael J. Striker

(57) ABSTRACT

In a method for operating an internal combustion engine with an electrically openable and closable fuel injector (18), the injectors are reliably held open in all operating conditions by the fact that the holding current for an open valve (18) is switched from a standard value to a higher value in certain operating states of the internal combustion engine, and it is reset to the standard value when the certain operating condition has ended.

6 Claims, 2 Drawing Sheets

METHOD FOR OPERATING AN INTERNAL COMBUSTION ENGINE

CROSS-REFERENCE

The invention described and claimed hereinbelow is also described in PCT/EP2005/056036, filed on Nov. 17, 2005 and DE 102004062020.2, filed Dec. 23, 2004. This German Patent Application, whose subject matter is incorporated here by reference, provides the basis for a claim of priority of invention under 35 U.S.C. 119 (a)-(d).

BACKGROUND OF THE INVENTION

The present invention relates to an internal combustion engine and a method for operating it.

To hold open an inwardly opening, high pressure fuel injection solenoid valve used with gasoline direct injection, a holding phase is used, in which the current flowing through the high pressure injector is regulated with respect to an effective holding current value. The current regulation is carried out by an output stage of the electronic control unit, which results in a power loss that is a function of the flowing current. With large-scale integrated output stages in particular, the power loss can result in overheating and resultant failure of the output stage, which, in turn, can result in misfires. In these cases, the heat dissipation capability of the printed circuit board must be improved locally, which results in higher costs. The dispersion of the fuel injected by the high pressure injector is poorer the higher the holding current is, since the turn-off time of the current and, therefore, the valve closing time and the excess quantity injected depend on the level of the holding current. The level of the holding current is determined primarily by the maximum system pressure (against which the high pressure injector must be held open) and by the static flow rate.

The highest system pressure that exists during normal operation in systems with gasoline direct injection is determined via the opening of a pressure-limiting valve. The opening pressure of the pressure-limiting value is reached in two cases of normal operation. The first case is a hot start, i.e., a starting procedure after a shutoff phase, which is accompanied by an increase in pressure in the high pressure fuel system due to the fuel heating up. The fuel in the fuel system is heated up by the heat transferred from an engine that had been previously driven under full load and was therefore heated up to an extreme extent. The second case is the resumption of fuel injection after an overrun condition. In an overrun condition, fuel injection is halted, and pressure increases in the high pressure fuel system for the reason given above. In both cases, the pressure in the high pressure fuel system is lowered after a few injections to a normal, lower pressure level. The holding current is designed for the maximum attainable pressure, however, which is the opening pressure of the pressure-limiting valve. The power loss produced by the output stage and the dispersion of the fuel injected by the high pressure injector could be reduced if a reduced holding current were used. This is possible, in principle, except in the two cases mentioned above.

The object of the present invention is to make it possible for the valves to be held open reliably in all operating conditions.

SUMMARY OF THE INVENTION

This problem is solved by a method for operating an internal combustion engine with an electrically openable and closable fuel injector that is characterized by the fact that the holding current for an open valve is switched from a standard value to a higher value in certain operating states of the internal combustion engine, and it is reset to the standard value when the certain operating condition has ended.

An advantage of the present invention is the fact that the cooling conditions of the output stage can be dimensioned for normal operation. This would make it possible to forego an improved, costly heat dissipation capability of the printed circuit board. It is not necessary to over-dimension the cooling conditions of the electronic control unit due to the system dimensioning for the hot start and resumption after overrun fuel cutoff. The fuel metering error of the high pressure injector is reduced without the need to implement costly measures, such as modifying the design, sorting, etc. In addition, the force used to hold the high pressure injector open can optionally be increased, e.g., by increasing the static flow rate of the valve. By using a greater static flow rate, a supercharged version of an engine series can be served, for example. When the static flow rate is greater, the start-up behavior at low temperatures is also improved. The increase is restored to normal as soon as the fuel pressure is reduced after a few injections. The power loss of the output stage is therefore reduced and, due to the few injections carried out with the modified holding current, the output stage is not impermissibly heated up. The fuel metering accuracy of the high pressure injector is also improved.

The current profile is generally changed at start-up, thereby ensuring that the high pressure injectors are held open until the opening pressure of the pressure-limiting valve is reached. At the end of the starting procedure, the reduced holding current is re-activated for normal operation. If the system pressure exceeds a certain pressure threshold in overrun, the holding current is changed for the subsequent resumption phase. The first fuel injections in the resumption phase will then require a higher holding current. As soon as the system pressure falls back below the pressure threshold, the holding current is reset to the original, lower level.

In a refinement of the present invention, it is provided that, during a start procedure of the internal combustion engine, the holding current for the open valve is switched from the standard value to the higher value, and it is reset to the standard value upon transition to normal operation. It can also be provided that the holding current for the open valve is switched from the standard value to the higher value when an overrun condition ends, and it is reset to the standard value upon transition to normal operation.

In a refinement of the present invention, it is provided that, when a fault condition "maximum delivery by the high pressure pump" occurs, the holding current for the open valve is switched from the standard value to the higher value, and, when the fault is eliminated, the higher value is reset to the standard value. The fault condition "maximum delivery by the high pressure pump" is understood to mean, in particular, the case in which the high pressure pump pumps, unregulated, with maximum output.

In a refinement of the present invention, it is provided that the switch between the standard value and the higher value takes place within one injection cycle.

In a refinement of the present invention, it is provided that the holding current for the open valve is switched from the higher value to the standard value when the rail pressure falls below a lower threshold. When it does fall below a lower threshold, transition to normal operation occurs.

In a refinement of the present invention, it is provided that the holding current for the open valve is switched from the higher value to the standard value when the number of injections carried out with the higher value of the holding current exceeds a maximum value. The higher value of the holding current is therefore maintained only for a certain period of time, which is measured, e.g., by the number of fuel injections carried out.

The problem stated initially is also solved by providing an internal combustion engine with an electrically openable and closeable fuel injector, which is characterized by the fact that the holding current for the open valve can be switched from a standard value to a higher value.

BRIEF DESCRIPTION OF THE DRAWINGS

An exemplary embodiment of the present invention is explained below in greater detail with reference to the attached drawing.

DETAILED DESCRIPTION OF THE PREFERRED EMBODIMENTS

Figure 1:
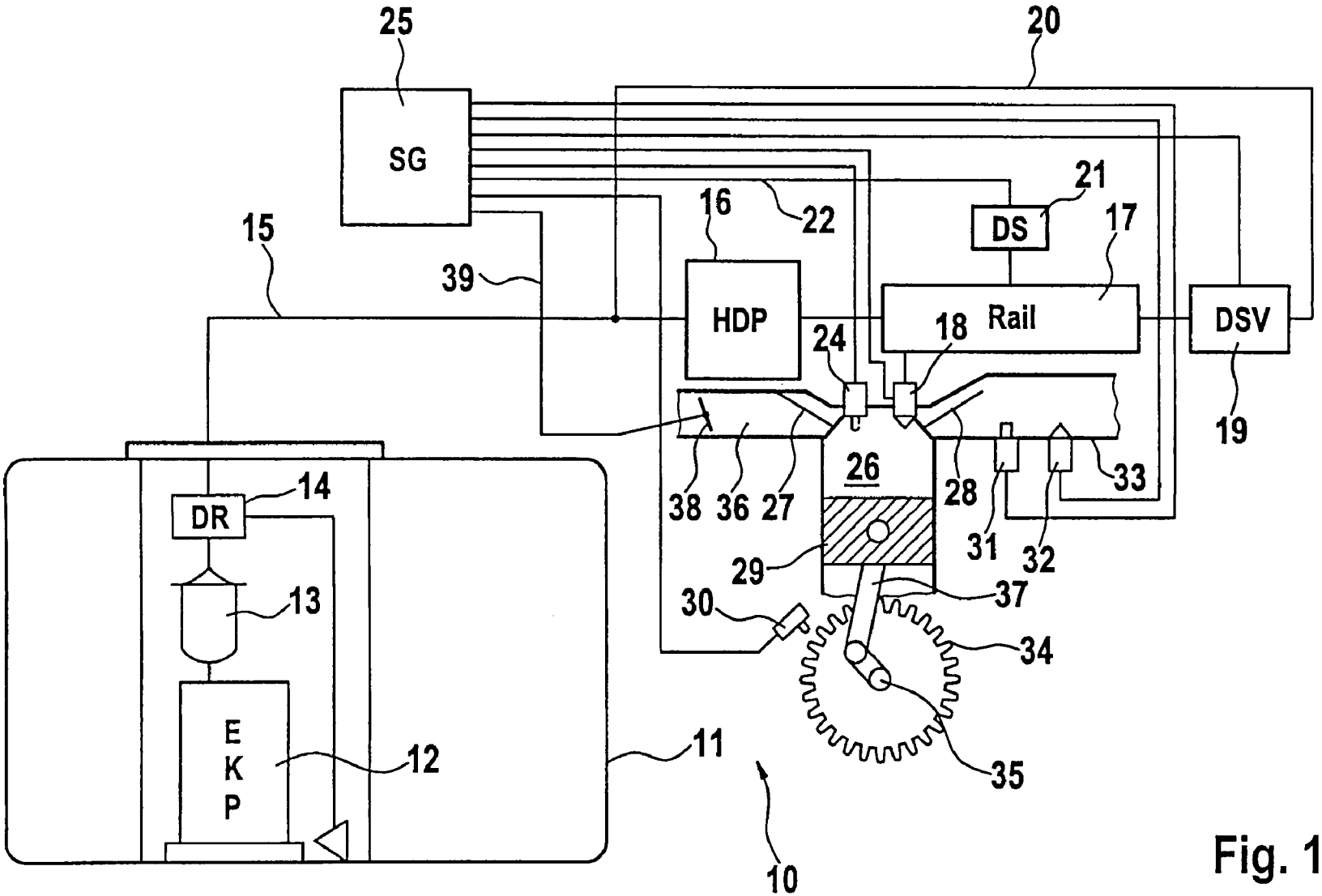
FIG. 1 shows a schematic depiction of a cylinder of an internal combustion engine with a fuel supply system.

FIG. 1 shows a schematic depiction of a cylinder of an internal combustion engine with associated components of the fuel supply system. The figure shows an internal combustion engine with direct injection (gasoline direct injection, Dl) with a fuel tank 11, on which electric fuel pump (EKP) 12, a fuel filter 13 and a low pressure regulator 14 are located. From fuel tank 11, a fuel line 15 leads to a high pressure pump 16. Storage chamber 17 is connected to high pressure pump 16. Fuel injectors 18 are located on storage chamber 17, fuel injectors 18 preferably being assigned directly to combustion chambers 26 of the internal combustion engine. With internal combustion engines with direct injection, at least one fuel injector 18 is assigned to each combustion chamber 26, although a plurality of fuel injectors 18 can also be provided for each combustion chamber 26. The fuel is pumped by electric fuel pump 12 out of fuel tank 11 through fuel filter 13 and fuel line 15 to high pressure pump 16. Fuel filter 13 removes foreign particles from the fuel. With the aid of low pressure regulator 14, the fuel pressure is regulated in a low pressure area of the fuel supply system to a predetermined value, which is usually in the magnitude of approximately 4 to 5 bar. High pressure pump 16, which is preferably driven directly by the internal combustion engine, compresses the fuel and pumps it into storage chamber 17. The fuel pressure reaches values of up to approximately 150 bar. A combustion chamber 26 of an internal combustion engine with direct injection is shown in FIG. 1 as an example. The internal combustion engine generally includes a plurality of cylinders, each with its own combustion chamber 26. At least one fuel injector 18, at least one spark plug 24, at least one intake valve 27, and at least one exhaust valve 28 are located on combustion chamber 26. The combustion chamber is limited by a piston 29 that can move up and down in the cylinder. Through intake valve 27, fresh air is drawn out of an induction tract 36 into combustion chamber 26. With the aid of injection valve 18, the fuel is injected directly into combustion chamber 26 of the internal combustion engine. The fuel-air mixture is ignited using spark plug 24. The expansion of the ignited fuel-air mixture drives piston 29. The motion of piston 29 is transferred via a connecting rod 37 to a crankshaft 35. A segment disk 34 that is scanned by a speed sensor 30 is located on crankshaft 35. Speed sensor 30 produces a signal that characterizes the rotary motion of crankshaft 35.

The exhaust gasses produced during combustion leave combustion chamber 26 via exhaust valve 28 and enter exhaust pipe 33, in which a temperature sensor 31 and a lambda probe 32 are located. The temperature is detected with the aid of temperature sensor 31, and the oxygen content in the exhaust gasses is detected with the aid of lambda probe 32.

A pressure sensor 21 and a pressure control valve 19 are connected to storage chamber 17. Pressure control valve 19 is connected at the inlet side with storage chamber 17. On the outlet side, a return line 20 returns to fuel line 15. A throttle valve 38 is located in induction tract 36, the rotary position of which is adjustable using electronic control unit 25 via a signal line 39 and an associated electric actuator, which is not shown here.

Figure 2:
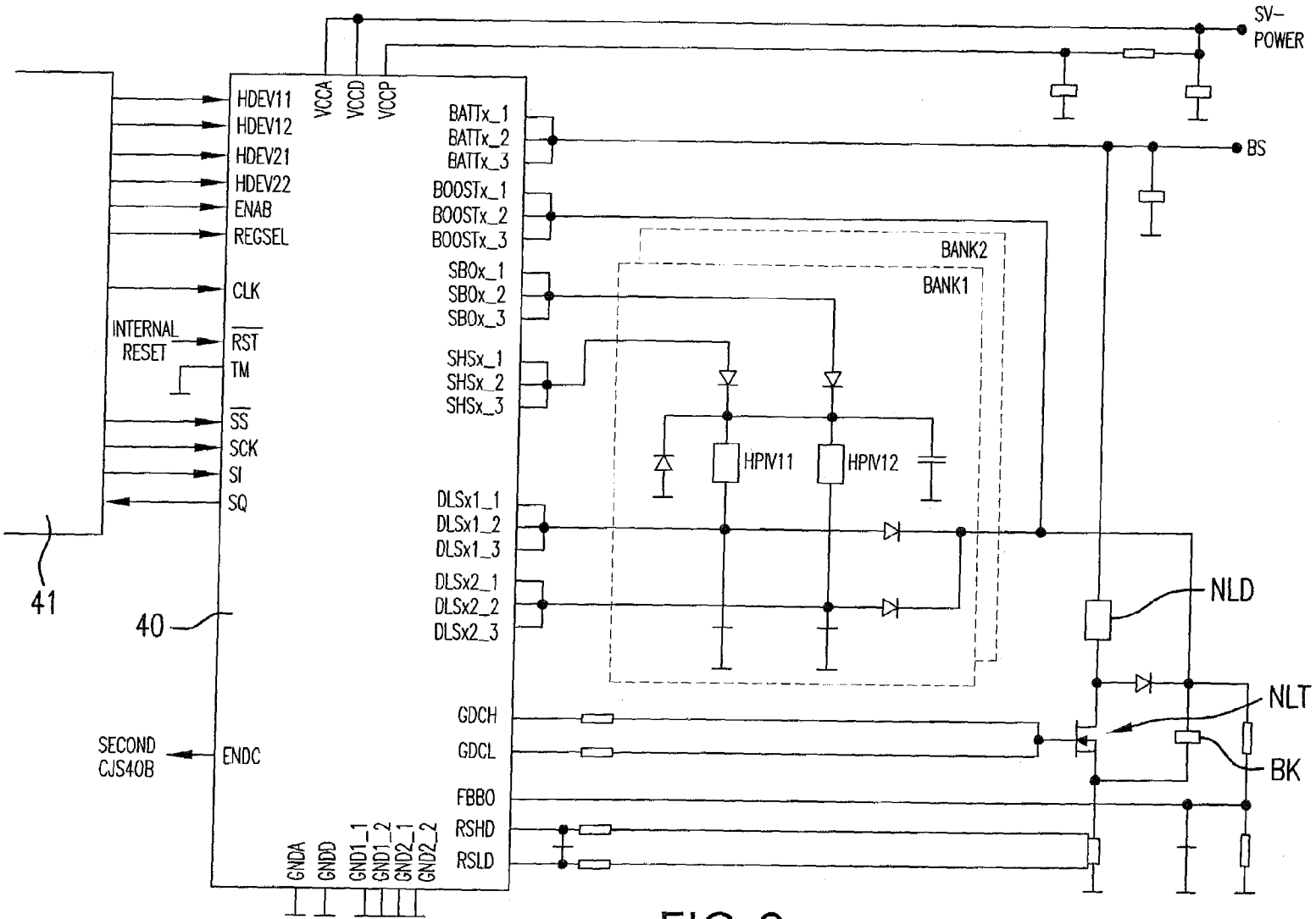
FIG. 2 shows a sketched circuit diagram with electronic control unit and injection nozzles.

Instead of a pressure control valve 19, a fuel supply control valve can also be used in fuel supply system 10. With the aid of pressure sensor 21, the actual value of the fuel pressure in storage chamber 17 is detected and fed to an electronic control unit 25. Using electronic control unit 25, a control signal is created based on the detected actual value of the fuel pressure and is used to control the pressure control valve. The electrical control of fuel injectors 18 is not shown in FIG. 1, it is depicted in FIG. 2. The various actuators and sensors are connected with electronic control unit 25 via control signal lines 22. Various functions that serve to control the internal combustion engines are implemented in electronic control unit 25. In modern electronic control units, these functions are programmed on a computer and are subsequently stored in a memory of electronic control unit 25. The functions stored in the memory are activated depending on the requirements of the internal combustion engine; strict requirements are placed on the real-time capability of electronic control unit 25 in particular. In principle, a pure hardware realization of the control of the internal combustion engine is possible as an alternative to a software realization.

The connection of the fuel injectors, which are labeled HPIV 11 and HPIV 12 in this case, with electronic control device 25 is shown in FIG. 2. For simplicity, the indices of outputs BATTX, BOOSTX, SPOX, SHSX, DLSX1 and DLSX2—each of which is present in triplicate—are not included in the depiction below. The sketch shows, as an example, a four-cylinder engine with two banks, labeled bank 1 and bank 2 in this case, although only bank 1 is presented in greater detail. In this case, electronic control unit 25 includes an output stage 40 for controlling fuel injectors HPIV 11 and HPIV 12, and a microcontroller 41 for controlling the functions of electronic control unit 25. The control of fuel injectors HPIV 11 and HPIV 12 is carried out such that output stage 40 activates signals BOOSTx_1 through BOOSTx_3 to SBOx_1 through SBOx_3 in the booster phase, it activates DLSX1_1 through DLSX1_3 to control HPIV11 to ground. As a result, a strong current flows through HPIV11. The necessary booster current is taken from a booster capacitor BK via inputs BOOSTX_1, etc. Booster capacitor BK is discharged every time one of the fuel injectors opens and, in the meantime, is discharged via a recharge choke NLD, which is connected to a battery supply voltage BS. A recharge transistor NLT serves to control the recharging process.

After the booster phase, output stage 40 activates signals BATTx_1 through BATTx_3 to SHSx_1 through SHSx_3, and it connects DLSX1_1 through DLSX1_3 for controlling HPIV11 to ground. As a result, a smaller current flows through HPIV11 in the holding phase. Output SHSX supplies a basic voltage to hold the valve open. The holding current is regulated with respect to a certain, preselected level by the switching on and off of BATTx_1 through BATTx_3 to SHSx_1 through SHSx_3.

The booster current level can be adjusted in steps by microcontroller 31, e.g., between 1.9 and 2.5 amperes, in increments of 0.2 amperes. If the level of the holding current is set this high, the power loss resulting from the current flow becomes too high. If the heat dissipation from the output stage is inadequate, this results in overheating and, possibly, thermal shut-off of the output stage. To prevent overheating of the output stage, operation with the higher holding current is limited to a few injections. The switchover to normal operation can be prompted when a pressure threshold is fallen below. As an alternative, the switchover to normal operation can take place after a certain number of injections, whereby the number can depend on the operating state of the internal combustion engine, e.g., speed, load and the like.

What is claimed is:

1. A method for operating an internal combustion engine with an electrically openable and closable fuel injector (18), wherein the holding current for an open valve (18) is switched from a standard value to a higher value in certain operating states of the internal combustion engine, and it is reset to the standard value when the certain operating condition has ended, wherein the holding current for the open valve is switched from the higher value to the standard value when the number of injections carried out with the higher value of the holding current exceeds a maximum value.

2. The method as recited in claim 1, wherein, during a start procedure of the internal combustion engine, the holding current for the open valve is switched from the standard value to the higher value, and it is reset to the standard value upon transition to normal operation.

3. The method as recited in claim 1, wherein, when an overrun condition ends, the holding current for the open valve is switched from the standard value to the higher value, and it is reset to the standard value upon transition to normal operation.

4. The method as recited in claim 1, wherein, when a fault condition "maximum delivery by the high pressure pump HDP" occurs, the holding current for the open valve is switched from the standard value to the higher value, and, when the fault is eliminated, the higher value is reset to the standard value.

5. The method as recited in claim 1, wherein the switch between the standard value and the higher value takes place within one injection cycle.

6. The method as recited in claim 1, wherein the holding current for the open valve is switched from the higher value to the standard value when a rail pressure falls below a lower threshold.

* * * * *